US006358193B1

(12) United States Patent
Nyberg

(10) Patent No.: US 6,358,193 B1
(45) Date of Patent: Mar. 19, 2002

(54) REGULATION DEVICE FOR A CENTRIFUGAL SEPARATOR TO CONTROL DISCHARGE FROM OUTLETS

(75) Inventor: Sven Olof Nyberg, Tumba (SE)

(73) Assignee: Alfa Laval AB, Lund (SE)

( * ) Notice: Subject to any disclaimer, the term of this patent is extended or adjusted under 35 U.S.C. 154(b) by 0 days.

(21) Appl. No.: 09/486,886

(22) PCT Filed: Sep. 14, 1998

(86) PCT No.: PCT/SE98/01630

§ 371 Date: Mar. 3, 2000

§ 102(e) Date: Mar. 3, 2000

(87) PCT Pub. No.: WO99/16550

PCT Pub. Date: Apr. 8, 1999

(30) Foreign Application Priority Data

Sep. 29, 1997 (SE) ..... 9703513

(51) Int. Cl.[7] ..... B04B 11/04
(52) U.S. Cl. ..... 494/2; 494/10; 494/27
(58) Field of Search ..... 494/1–7, 10, 11, 494/23, 25–30, 56, 68, 70; 210/209, 210

(56) References Cited

U.S. PATENT DOCUMENTS 3,167,509 A * 1/1965 Steinacker
3,255,958 A * 6/1966 Simon
3,445,061 A * 5/1969 Nilson
3,593,915 A * 7/1971 Steinacker
3,938,734 A 2/1976 Wilke
3,976,242 A * 8/1976 Hemfort
4,014,498 A 3/1977 Broadwell et al.
4,305,817 A * 12/1981 Kohlstette
4,510,052 A 4/1985 Eklof
4,820,256 A * 4/1989 Nordstrom ..... 494/3
4,840,612 A * 6/1989 Pallmar ..... 494/70
5,800,330 A * 9/1998 Modeer ..... 494/2

FOREIGN PATENT DOCUMENTS

DE 2017031 * 1/1971 ..... 494/2
DE 2342475 * 3/1975 ..... 494/3
DE 28 14 523 10/1979
WO 97/27945 8/1997

* cited by examiner

*Primary Examiner*—Charles E. Cooley
(74) *Attorney, Agent, or Firm*—Fish & Richardson P.C.

(57) ABSTRACT

In a centrifugal rotor (1) for separation of a substance from a liquid mixture supplied to the centrifugal rotor there is delimited a separation chamber (7) having peripheral outlets (30). The centrifugal rotor includes an outlet device (20–28) for intermittent opening and closing of the outlets (30) during rotation of the centrifugal rotor. An actuation device (31–40) may cause the outlet device (20–28) to keep the outlets (30) open to a varying extent and/or during a varying time, and a control device (43) is adapted to control the actuation device (31–40) in response to a sensed value of the amount of mixture supplied to the rotor, such that a predetermined amount of separated substance (29) having collected in the separation chamber (7) is discharged through the outlets (30) each time these are opened and closed.

10 Claims, 1 Drawing Sheet

REGULATION DEVICE FOR A CENTRIFUGAL SEPARATOR TO CONTROL DISCHARGE FROM OUTLETS

FIELD OF THE INVENTION

The present invention relates to a centrifugal separator comprising a rotatable centrifugal rotor, which delimits a separation chamber having peripheral outlets for a separated substance, a stationary inlet device for introducing into the centrifugal rotor a liquid mixture that contains said substance and that is to be treated in the separation chamber, an outlet device which is rotatable with the centrifugal rotor and adapted to open and close said peripheral outlets intermittently during rotation of the centrifugal rotor for discharging said separated substance from the separation chamber and an actuation device arranged outside the centrifugal rotor and adapted to actuate said outlet device so that it maintains the peripheral outlets open to an extent and/or during a time such that a predetermined amount of said separated substance leaves the centrifugal rotor, said extent and/or time being variable. Particularly, the invention concerns a control device for keeping constant the said amount of separated substance leaving the separation chamber each time said peripheral outlets are opened and closed.

BACKGROUND OF THE INVENTION

It is long known to use in connection with a centrifugal separator of the above defined kind sensing means by which it may be determined exactly when a certain amount of said separated substance has been accumulated in the centrifugal rotor separation chamber and, then, to open and close automatically said peripheral outlets. However, it has proven difficult during a separating operation to accomplish discharge of like amounts of such separated substance through the peripheral outlets each time these are opened and closed.

The reason for this difficulty seems to be that a centrifugal rotor of the kind here in question has a poor ability of maintaining the peripheral outlets open to the same extent and/or during the same time at each discharge operation and, therefore, to discharge alike amounts of substance at the various opening times. Thus, if a relatively small amount of substance is discharged, the substance if it is constituted by solid particles is given time to get a too high concentration of such particles before it is discharged through the peripheral outlets. This can lead to the effect that part of the separated substance is given time to fasten onto the inside of the walls of the centrifugal rotor before the peripheral outlets are opened. If, on the other hand, a relatively large amount of substance is discharged, the substance gets a too low concentration of particles, i.e. the discharged substance contains an undesired amount of the liquid from which the particles should be separated. This can lead to undesired losses, since it is often the liquid that is the valuable part of the mixture being supplied to the centrifugal rotor.

Even in separation cases where prior to a sludge discharge operation a valuable separated liquid is displaced radially inwardly in the separation chamber, by supply to the separation chamber of a certain amount of a less valuable liquid having a higher density than the valuable liquid, it may be of value that a well controlled amount of separated substance (particles and/or liquid) is discharged through the peripheral outlets each time these are opened and closed. Thus, it becomes possible to optimize the amount of added less valuable liquid before every time the peripheral outlets are to be opened. The supply of unnecessarily much liquid of this kind takes an undesired time into account during which the separating operation is interrupted.

For resolving the above discussed problem to discharge a predetermined amount of separated substance through the peripheral outlets, each time these are opened and closed, design improvements have been constantly made of said outlet device of the rotor and of the actuation device situated outside the centrifugal rotor for actuation of the outlet device. However, this has not completely resolved the problem. Previously known devices for accomplishing a desired discharge of separated substance from a centrifugal rotor of the kind here in question is described for instance in U.S. Pat. No. 4,510,052 and WO 97/27 945.

SUMMARY OF THE INVENTION

The object of the present invention is to provide a control device by means of which the amount of separated substance leaving the separation chamber in a centrifugal rotor of the kind initially defined can be kept substantially unchanged every time the outlet device opens and closes the peripheral outlets.

This object can be fulfilled according to the invention by means of a regulation device that is characterized by a sensing device for sensing of a parameter representative for the amount of mixture supplied per unit of time into the centrifugal rotor through said inlet device, and a control device which is connected both to the sensing device and to said actuation device, the control device being adapted to receive from the sensing device a signal reflecting the amount of mixture, which per unit of time is supplied into the centrifugal rotor, and in response to said signal to control the actuation device—in accordance with a predetermined relation between the amount of mixture supplied per unit of time into the centrifugal rotor through the inlet device and the extent and/or the time that the peripheral outlets are to be maintained open by means of the outlet device—such that said predetermined amount of the separated substance leaves the centrifugal rotor. The said relation in certain cases may be calculated but in other cases has to be determined empirically.

Conventionally, in connection with a centrifugal separator of the kind here in question, the said outlet device is adapted to actuate one or more valves or slides of the centrifugal rotor by means of a fluid—liquid or pressurized air—supplied to the centrifugal rotor by means of said actuation device outside the centrifugal rotor. An outlet device of this kind may be used with advantage even in connection with the present invention. However, within the scope of the invention, even electrically, magnetically, thermally or otherwise actuatable outlet devices may be useful.

Upon use of an outlet device that is actuatable by means of a supplied fluid this outlet device may be of various kinds. Thus, the outlet device may be adapted to open said peripheral outlets and keep these open to a varying extent or during a varying time depending upon the pressure by which said fluid is supplied by means of the actuation device. Alternatively, the outlet device may be adapted to operate in dependence of the amount of fluid or the amount of fluid per unit of time delivered by the actuation device.

Even the actuation device may be of most varying kinds. In a case where said fluid is a liquid and such liquid is to be supplied to the outlet device at a variable but predetermined pressure, the actuation device may include a container for the liquid and a movable body, e.g. a piston, within the container for displacement of the liquid out of the container. Further, the actuation device may include a container for pressurized air, possibly formed by part of the container for liquid.

The above said sensing device may be constituted by a conventional mass or volume flow meter or by any suitable kind of equipment which directly or indirectly is able to sense the magnitude of a liquid flow through the inlet device of the centrifugal separator, e.g. a pressure meter. The sensing device should be adapted to emit a signal of any suitable kind that is representative for the magnitude of the sensed liquid flow. The signal may have the form of an electric current or voltage, the magnitude of which is dependent on the magnitude of the sensed liquid flow.

The control device which shall receive the signal generated by the sensing device should be adapted in one way or another to control the aforementioned actuation device. The way in which such a control is accomplished is, of course, dependent on the type of actuation device having been chosen.

In a very simple case the actuation device may be adapted to supply through a conduit a so called operating liquid having a certain pressure. Then, a closing valve may be present in said conduit, which valve may be opened and be kept open during a certain controllable period of time. By means of an actuation device of this kind a desired amount of liquid may be supplied to the centrifugal rotor during a desired period of time. Whereas the opening movement of said valve may be initiated by an equipment adapted to determine the point of time when the peripheral outlets of the centrifugal rotor are to be opened, the time for keeping the valve open may be controlled by said control device in dependence of the signal from the sensing device.

In another case, which is described in detail below with reference to the accompanying drawings, the actuation device may be adapted to deliver a liquid flow by means of pressurized air, the pressure of which is variable. Thus, the magnitude of said air pressure may be controlled by means of the control device in dependence of the signal from the sensing device, the actuation device further being adapted to supply only a certain amount of so called operating liquid during a time that is dependent on the chosen air pressure.

Other possibilities are described in the aforementioned patent specifications U.S. Pat. No. 4,510,052 and WO 97/27 945.

BRIEF DESCRIPTION OF THE DRAWINGS

The invention will be described more in detail below with reference to the accompanying drawing, in which FIG. 1 schematically shows part of a centrifugal rotor in section and various components included in a regulation device according to the invention.

DETAILED DESCRIPTION

Figure 1:
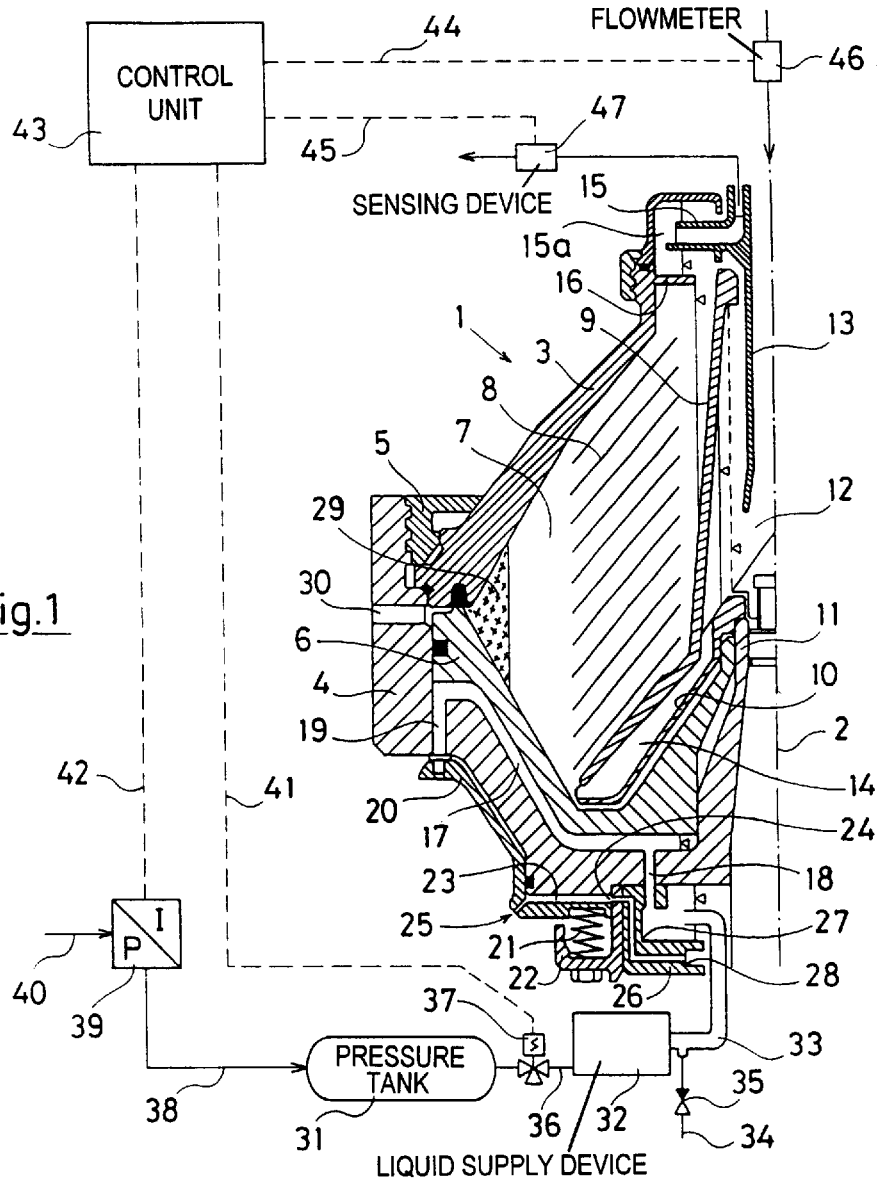

FIG. 1 shows a part of a centrifugal rotor 1 that is rotatable around a center axis 2 and that comprises an upper part 3 and a lower part 4. The rotor parts 3 and 4 are connected with each other by means of a lock ring 5. Within the rotor there is arranged an annular slide 6 which is axially movable a short distance to and from abutment against a lower annular edge portion of the upper rotor part 3 under radial sealing against the lower rotor part 4 centrally within the rotor as well as at the surrounding portion of the rotor.

Within the rotor a separation chamber 7 is delimited between the upper rotor part 3 and the slide 6, in which there is arranged a stack of frustoconical separation discs 8 coaxial with the rotor.

The stack of separation discs rests on a lower part of a so called distributor 9, which in turn rests on a conical partition 10 supported by a central portion 11 of the lower rotor part 4.

The distributor 9, which has an annular cross-section, surrounds an inlet chamber 12 into which there extends a stationary inlet pipe 13 for a liquid mixture to be treated in the rotor. The inlet chamber 12 communicates with the separation chamber 7 through several channels distributed around the rotor center axis 2 and delimited between the conical partition 10 and said portion of the distributor 9. The partition 10 carries on its upper side radially and axially extending wings 14 between which said channels extend.

The inlet pipe 13 supports above the distributor 9 a so called paring disc 15 adapted for discharge of liquid out of the rotor. The paring disc 15 extends from the inlet pipe 13 radially out into an outlet chamber 15*a*. Between the outlet chamber 15*a* and the separation chamber 7 the upper rotor part 3 carries on its inside an annular partition 16, the inner edge of which forms an overflow outlet for liquid from the separation chamber 7 to the outlet chamber 15*a*.

Between the lower rotor part 4 and the annular slide 6 there is formed a so called closing chamber 17. This has a constantly open inlet 18 for operating liquid close to the rotor center and closeable outlets 19 for such liquid in the vicinity of the rotor periphery. When the outlets 19 are closed and the closing chamber 17 is filled with operating liquid, the slide 6 is kept in its upper position as can be seen from FIG. 1, in which it abuts axially against the edge portion of the upper rotor part 3.

The rotor 1 supports on its underside an annular slide 20, which is axially movable relative to the rotor in a way such that part of the slide 20 may close alternatively uncover the outlets 19 from the closing chamber 17. The slide 20 is pressed axially against the underside of the rotor by several springs 21, which are distributed around the rotor center axis and which are supported by a support device 22. The support device 22 is firmly connected with the lower part 4 of the rotor. Between the slide 20 and the rotor part 4 there is delimited an annular so called opening chamber 23, which has at least one central inlet 24 and at least one outlet 25 at its radially outermost part.

The support device 22 supports an annular member 26, which forms a radially inwardly open first annular groove 27 that communicates with the inlet 18 of the closing chamber 17. The member 26 also forms a second such groove 28, which communicates with the inlet 24 of the opening chamber 23. The second groove 28 is situated at a level radially inside the first groove 27.

The above described details 20–28 and the annular slide 6 constitute together an outlet device rotatable together with the centrifugal rotor for the discharge of a separated substance 29 from the separation chamber 7, when the slide 6 leaves its abutment against the upper rotor part 3. Outside the annular slot which is then formed the lower rotor part 4 has several ports 30 evenly distributed along the rotor periphery.

Below the centrifugal rotor 1 there is arranged an actuation device for actuation of the just mentioned outlet device in a desired manner. This actuation device comprises a pressure tank 31 for pressurized air and a liquid supply device 32 arranged for supply of so called operating liquid to the centrifugal rotor. A liquid supply pipe 33 leads from the device 32 into the groove 27 and communicates through a conduit 34 with a source of operating liquid. The conduit 34 has a check valve 35.

In a conduit 36, which connects the pressure tank 31 with the device 32, there is arranged a three-way valve 37.

The pressure tank 31 also communicates with a supply conduit 38 for pressurized air. This supply conduit 38 starts from a current/pressure converter 39, which in turn through a conduit 40 communicates with a pressurized air source (not shown).

The three-way valve 37 and the current/pressure converter 39 are connected through signal lines 41 and 42, respectively, with a control unit 43. This is also connected through signal lines 44 and 45 with a flow meter 46, e.g. mass flow or a volume flow meter, which is arranged in an inlet device (not shown) through which the centrifugal rotor can be charged with a liquid mixture, and with a sensing device 47, respectively, which is arranged in a n outlet conduit through which a liquid separated in the centriftugal rotor may leave this. The function of the sensing device 47 will be described later.

Figure 2:
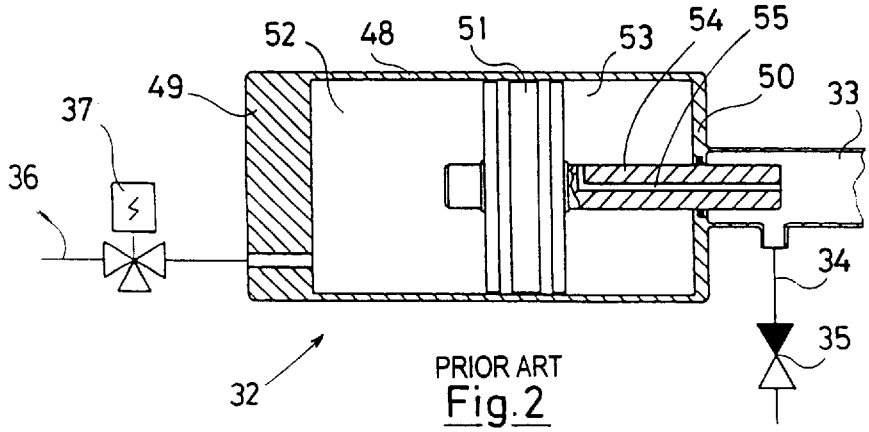
PRIOR ART Fig.2
FIG. 2 shows more in detail an actuation device included in the regulation device.

FIG. 2 shows the liquid supply device 32 more in detail. FIG. 2 also shows the supply conduit 36 for pressurized air, the three-way valve 37 therein, a part of the supply pipe 33 for operating liquid, the conduit 34 and the check valve 35.

The liquid supply device 32 includes a cylindrical container 48 having end walls 49 and 50. Within the container 48 a piston 51 is axially movable between two end positions under sealing against the surrounding wall of the container. In FIG. 2 the piston 51 is situated between its end positions. The piston 51 divides the interior of the container 48 in a first chamber 52 and a second chamber 53.

On its one side the piston 51 is connected with a central piston rod 54, which in the shown position of the piston extends through an opening in the end wall 50 and into the pipe 33.

The piston rod 54 has a central channel 55, which at one of its ends opens at the free end of the piston rod and at its other end—through a radially extending channel part—opens into the chamber 53.

While the chamber 52 through a hole in the end wall 49 constantly communicates with the supply conduit 36 for pressurized air, the chamber 53 constantly communicates with the interior of the supply pipe 33 for operating liquid; either directly through said opening in the end wall 50, when the piston 51 is situated in the left half of the container 48, or through the channel 55 in the piston rod 54, when the piston 51 is situated in the right half of the container 48.

The centrifugal separator in the FIGS. 1 and 2 operates in the following manner.

After the centrifugal rotor 1 has been caused to rotate around the center axis 2 it is charged through the flow meter 46 and the inlet pipe 13 a liquid containing a substance dispersed therein in the form of small solids, which has a higher density than the liquid. The supplied liquid mixture is conducted through the inlet chamber 12 and the channels between the wings 14 into the separation chamber 7. When this is full and liquid begins to be discharged from the rotor through the paring disc 15, free liquid surfaces are formed in the inlet chamber 12, the separation chamber 7 and the outlet chamber 15*a* at the radial levels shown by full lines provided with small triangles in FIG. 1.

During the rotation of the rotor the solids dispersed in the liquid are separated by moving radially outwardly in the separation chamber 7. They collect in a layer 29 in the radially outermost part of the separation chamber, the so called sludge space. Liquid cleaned from particles discharges gradually through the overflow outlet formed by the partition 16 and through the paring disc 15. After some time of separation the separation chamber 7 has to be freed from the whole or part of the amount of particles having accumulated therein. This can take place after a predetermined time period of separation or when it has been sensed in one way or another that a certain amount of particles has accumulated in the separation chamber. FIG. 1 shows schematically a sensing device 47 for this purpose. This sensing device is adapted to sense when the liquid discharging from the rotor starts to be turbid. Such a turbidity indicates that the separation going on is no longer sufficiently effective, which in turn indicates that the interface layer between the accumulated particles and the cleaned liquid has reached into a certain radial level in the separation chamber. A signal about this is sent from the sensing device 47 to the control unit 43, which then initiates a so called sludge discharge operation.

The equipment used for sensing that a certain amount of particles has collected in the separation chamber may be of any desired suitable kind. Many different kinds of such equipment are previously known. It is not necessary for the use of the present invention that a sensing equipment of the kind here concerned is used at all.

Before a sludge discharge operation is initiated, the control unit 43 has received a signal from the flow meter 46 through the signal line 44 concerning the prevailing liquid flow into the inlet pipe 13. This signal has been converted to a weak electric current that through the signal line 42 has been brought to actuate the current/pressure converter 39. In dependence of the current strength the current/pressure converter 39 has adapted the setting of a pressure reduction valve (not shown) in a way such that a relatively high pressure, e.g. 8 Bar, prevailing in the conduit 40, has been reduced to a somewhat lower pressure, e.g. 5 Bar, which is maintained in the conduit 38 and then also in the pressure tank 31.

Depending upon which liquid flow that has been sensed by the flow meter 46 the air pressure in the pressure tank 31 may be adjusted to a value between for instance 3–6 Bar. An adjustment of this kind may be performed either continuously depending upon occurring changes of the sensed liquid flow or discontinuously, e.g. at predetermined time intervals or immediately before a sludge discharge operation is to be initiated.

Upon initiation of a sludge discharge operation a signal is sent from the control unit 43 through the signal line 41 to the three-way valve 37, which then is caused to open a previously closed connection between the pressure tank 31 and the chamber 52 in the cylinder 48 (FIG. 2).

Hereby, the piston 51 which at this stage is situated at its end position closest to the end wall 49 is caused to move rapidly to the right with respect to FIG. 2 and, then, to displace operating liquid (usually water) out of the chamber 53 through the pipe 33 to the annular groove 27 in the rotor (FIG. 1).

It should be mentioned that the pipe 33 and the chamber 53 have been kept completely filled with operating liquid through the conduit 34 before said movement of the piston 51. This has been accomplished in that a predetermined constant liquid pressure is maintained in the conduit 34, which liquid pressure ensures that the free cylindrical liquid surface in the groove 27 is maintained at a predetermined radial level indicated by a triangle in FIG. 1.

When the piston 51 pumps operating liquid from the chamber 53 out into the pipe 33, this happens by a pressure which substantially exceeds the said predetermined constant pressure in the conduit 34. Thanks to the check valve 35 all this liquid will be conducted through the pipe 33 into the groove 27 in the rotor. The liquid surface in the groove 27 then will move radially inwardly, until liquid starts to flow over the lower limiting wall of the groove 27 and into the groove 28. From the groove 28 the liquid is further conducted into the opening chamber 23, which is partly filled.

When a sufficient amount of liquid has entered the opening chamber 23 for overwinning of the force from the springs 21, the slide 20 starts to move downwardly, so that the outlets 19 of the closing chamber 17 are opened. However, already before the outlets 19 are opened, the liquid surface in the opening chamber 23 will move to a level radially inside the level, at which the slide 20 starts to move downwardly; this as a consequence of the outflow through the outlet 25 from the opening chamber 23 being smaller than the inflow through the inlet 24 to the opening chamber 23. Thus, it is the flow speed of the liquid flowing in through the inlet 24 which decides how much liquid that is given time to be supplied to the opening chamber 23.

When the slide 20 moves downwardly, operating liquid starts to leave the closing chamber 17, the free liquid surface in the closing chamber 17 as well as the free liquid surface in the groove 27 starting to move radially outwardly. Then, the flow of operating liquid from the groove 27 to the groove 28 will be interrupted, but thanks to the fact that the outlet 25 from the opening chamber 23 is heavily throttled, so much liquid is maintained during a certain period of time in the opening chamber 23 that the pressure force therefrom overwins the force of the springs 21. The outlets 19 from the closing chamber 17 remain open during this time.

When the liquid surface in the closing chamber 17 moves radially outwardly, the axial force of the liquid in the closing chamber on the slide 6 is reduced, so that after a short period of time it becomes smaller than the counter directed force on the slide 6 from liquid and the separated substance in the separation chamber 7. Hereby, the slide 6 will be pressed axially downwardly and uncover the peripheral outlet openings 30 in the rotor part 4, so that separated substance starts to be thrown out through these outlet openings.

At this stage so much operating liquid has left the opening chamber 23 through the openings 25 that the force from the springs 21 can again bring the slide 20 axially upwardly to closing of the outlets 19 from the closing chamber 17.

This means that the movement radially outwardly of the liquid surface in the closing chamber 17 is interrupted. As a consequence of new operating liquid constantly being supplied to the groove 27 and the inlet 18, as will be described later, the liquid surface in the closing chamber 17 will not stop at a certain level, however, but instead begin to move radially inwardly.

After a very short time the closing chamber 17 will contain so much operating liquid that the force therefrom on the slide 6 overwins the counteracting force thereon from liquid and possibly remaining separated substance in the separation chamber 7. Then the slide 6 again closes the peripheral outlets 30.

Before the piston 51 is moved to the left with reference to FIG. 2, the control equipment 43 has adjusted the three-way valve 37 so that the chamber 52 is put into communication with the surrounding atmosphere.

The supply device 32 operates in the following manner.

When the three-way valve 37 is adjusted so that the pressure tank 31 is put into communication with the chamber 52, the piston 51 moves to the right under displacement of operating liquid from the chamber 53 out into the pipe 33 and further to the groove 27 in the rotor. This happens relatively rapidly until the piston rod 54 reaches up to and covers the opening in the end wall 50. Dependent upon the adjusted air pressure in the pressure tank 31 it takes a longer or shorter time for the piston 51 to move the just mentioned distance, which means that the set air pressure decided the flow speed (I/h) by which a predetermined amount of operating liquid is pumped into the groove 27 in the rotor.

This flow speed corresponds to the one by which operating liquid will flow from the groove 27 to the groove 28 and, thus, into the opening chamber 23. As mentioned earlier, this flow speed will be deciding for the radially innermost level, at which a free liquid surface will be situated in the opening chamber 23, when the slide 20 is situated in its lower position, i.e. when the outlets 19 from the closing chamber 17 are kept open. The closer the rotor center axis this level in the opening chamber 23 is situated, the longer time it will take before the opening chamber 23 has been emptied of so much operating liquid that the springs 21 return the slide 20 to closing of the outlets 19. This influences in its turn the amount of operating liquid which is given time to leave the closing chamber 17 and, thus, the radially outermost level to which the liquid surface in the closing chamber 17 is allowed to move. The position of this level determined in its turn how much separated substance that is allowed to leave the separation chamber 7, since the movement radially outwardly of the free liquid surface in the separation chamber will become dependent thereupon.

When the piston 51 has moved so far to the right in the cylinder 48 that the piston rod 54 covers the opening in the end wall 50, the liquid level in the groove 27 in the rotor has already started to move radially outwardly.

More or less liquid (or no liquid at all) is then left in the groove 27. When the piston 51 continues its movement to the right, a flow comes up through the channel 55 in the piston 54 from the chamber 53 to and through the pipe 33. This flow is substantially smaller than the flow previously caused by the piston 51 but larger and more controlled than the flow which can come up through the conduit 34 to the pipe 33.

The flow now accomplished by means of the piston 51 into the groove 27 and from there into the closing chamber 17 is to accomplish that the liquid surface in the closing chamber 17 moves radially inwardly faster than the corresponding movement of the free liquid surface in the separation chamber 7. If this does not happen, the slide 6 will again be pressed downwardly, namely, and uncover the outlet openings 30. That the liquid surface in the separation chamber 7 moves inwardly depends on the fact that the supply of mixture through the inlet pipe 13 is not interrupted during a sludge discharge operation.

When the piston 51 has reached its end position at the end wall 50, upon need further operating liquid is supplied automatically through the conduit 34, until the liquid surface in the groove 27 has retained its predetermined radial position, which corresponds to the aforementioned constant liquid pressure in the pipe 33 prevailing in the conduit 34 upstream of the check valve 35.

From what has been said it can be seen that setting of a lower or higher air pressure in the pressure tank 31 leads to a smaller or a larger, respectively, amount of separated substance leaving the separation chamber 7 during a sludge discharge operation.

As has been mentioned earlier, the present invention has for its object to accomplish a constant amount of separated substance being removed from the separation chamber at each sludge discharge operation. It has been proved that this can be obtained by actuation of the centrifugal rotor opening device for uncovering of the peripheral outlets 30 in dependence of the magnitude of the flow of liquid mixture being supplied to the centrifugal rotor.

A possible explanation to this is that a certain flow of liquid mixture into the centrifugal rotor through the inlet pipe 13 gives the result that a free liquid surface is formed at a certain level in the inlet chamber 12 (see the full line in FIG. 1), but that upon a larger flow a free liquid surface is formed at a level radially closer to the centrifugal rotor center axis (see the dotted line in FIG. 1).

The reason for this would be that the flow resistance for the liquid flowing in the separation chamber 7 through the very thin separation passages between the separation discs 8 increases by an increased flow through the centrifugal rotor.

Upon a changed liquid level in the inlet chamber 12, as just described, the force against the slide 6 from the liquid present in the separation chamber 7 will be changed, which influences the previously described course as to the movement of the slide 6. Thus, the slide 6 upon an increased liquid pressure in the separation chamber 7 will be subjected to an enlarged opening force, which—if the conditions on the operating liquid side of the slide 6 remain unchanged—leads to a prolonged opening time for the outlets 30 during a sludge discharge operation.

By the invention such an increased liquid pressure in the separation chamber 7 as a consequence of an increased flow into the centrifugal rotor may be compensated in a way such that a somewhat lower air pressure is set in the pressure tank 31. The result of this is that operating liquid is supplied to the rotor by means of the supply device 32 at a somewhat lower speed than normally, i.e. the opening chamber 23 will be filled to a somewhat smaller degree and, therefore, be emptied somewhat faster than normally. The movement radially outwardly of the free liquid surface in the closing chamber 17 thereby will be interrupted somewhat earlier than normally, i.e. in a radial position somewhat closer to the rotor center axis than normally.

Hereby, it has been achieved an adaptation of the liquid pressure on the slide 6 from the operating liquid in the closing chamber 17 in relation to the changed liquid pressure on the slide 6 from the liquid in the separation chamber 7.

A sensing device 46 has been described above as placed in connection to the stationary inlet pipe 13 of the centrifugal rotor for sensing of a parameter that is representative for the amount of mixture which per unit of time is conducted into the centrifugal rotor. However, a sensing device for this purpose need not be situated in connection to the stationary inlet pipe 13 but can, alternatively, be placed within the rotor or in a stationary outlet conduit from the rotor, wherethrough separated liquid leaves the rotor.

If the sensing device is arranged within the rotor, it may have the form of a liquid level meter, i.e. a floating body, in one of the chambers of the rotor, e.g. the inlet chamber 12. Alternatively, it may have the form of a pressure meter.

What is claimed is:

1. A regulation device for a centrifugal separator, which comprises a rotatable centrifugal rotor (1), which delimits a separation chamber (7) having peripheral outlets (30) for a separated substance, a stationary inlet device (13) for introducing into the centrifugal rotor a liquid mixture, which contains said substance and which is to be treated in the separation chamber (7), an outlet device (20-28), which is rotatable together with the centrifugal rotor (1) and adapted intermittently to open and close said peripheral outlets (30) during rotation of the centrifugal rotor for discharge of said separated substance from the separation chamber (7), and an actuation device (31-40) situated outside the centrifugal rotor (1) and adapted to actuate said outlet device (20-28) such that it maintains the peripheral outlets (30) open to an extent and/or during a time such that a predetermined amount of said separated substance leaves the centrifugal rotor (1), said extent and/or time being variable, wherein a sensing device (46) for sensing of a parameter that is representative for the amount of mixture which per unit of time is supplied into the centrifugal rotor (1) through said inlet device (13), and a control device (43), which is connected both to the sensing device (46) and to the actuation device (31-40), the control device (43) being adapted to receive from the sensing device (46) a signal reflecting the amount of mixture, which per unit of time is supplied into the centrifugal rotor (1), and in response to said signal to control the actuation device (31-40)—in accordance with a predetermined relation between the amount of mixture supplied per unit of time into the centrifugal rotor (1) through the inlet device and the extent and/or time that the peripheral outlets (30) are to be maintained open by means of the outlet device (20-28)—such that said predetermined amount of the separated substance leaves the centrifugal rotor (1).

2. A regulation device according to claim 1, in which the sensing device (46) is constituted by a flow meter placed in connection to said stationary inlet device (13).

3. A regulation device according to claim 2, in which the actuation device (31-40) is adapted to actuate the outlet device (20-28) by supply of an operating liquid to the centrifugal rotor.

4. A regulation device according to claim 3, which the actuation device (31-40) includes means for supplying a variable flow of operating liquid.

5. A regulation device according to claim 4, in which said means for supplying includes a pressure tank (31) arranged to contain pressurized air and a container (48) arranged to contain said operating liquid, a movable wall in the container (48), being arranged by actuation of the air pressure in the pressure tank (31) to displace said operating liquid out of the container, and said control device (43) being arranged to control the air pressure in the pressure tank (31) in dependence of said signal reflecting the amount of mixture which per unit of time is supplied into the centrifugal rotor (1).

6. The regulation device according to claim 5, in which said movable wall is a piston (51).

7. A regulation device according to claim 1, in which the actuation device (31-40) is adapted to actuate the outlet device (20-28) by supply of an operating liquid to the centrifugal rotor.

8. A regulation device according to claim 7, in which the actuation device (31-40) includes means for supplying a variable flow of operating liquid.

9. A regulation device according to claim 8, in which said means for supplying includes a pressure tank (31) arranged to contain pressurized air and a container (48) arranged to contain said operating liquid, a movable wall in the container (48), being arranged by actuation of the air pressure in the pressure tank (31) to displace said operating liquid out of the container, and said control device (43) being arranged to control the air pressure in the pressure tank (31) in dependence of said signal reflecting the amount of mixture which per unit of time is supplied into the centrifugal rotor (1).

10. The regulation device according to claim 9, in which said movable wall is a piston (51).

* * * * *